United States Patent [19]

Wiseman

[11] 4,151,788

[45] May 1, 1979

[54] PARTITION POSITIONER

[75] Inventor: John A. Wiseman, Lynchburg, Va.

[73] Assignee: Simplimatic Engineering Company, Lynchburg, Va.

[21] Appl. No.: 856,610

[22] Filed: Dec. 2, 1977

[51] Int. Cl.[2] ..... B31D 3/04

[52] U.S. Cl. ..... 93/37 R; 53/263

[58] Field of Search ..... 93/37 R, 36 R, 37 SP, 93/37 EC; 53/248, 262, 263

[56] References Cited

U.S. PATENT DOCUMENTS

| | | | |
|---|---|---|---|
| 2,024,201 | 12/1935 | Benoit et al. | 93/37 R |
| 4,034,656 | 7/1977 | Raudat et al. | 53/263 X |

*Primary Examiner*—James F. Coan

*Attorney, Agent, or Firm*—James & Franklin

[57] ABSTRACT

Apparatus for positioning intersecting partitions in a container to form compartments to receive articles comprises a support plate and a plurality of straightening heads extending from the support plate in a given direction. Each of the heads is adapted to engage a respective intersection of two partitions in the container and defines an intersecting pair of open bottom slots for receipt therein of the respective partition intersection. Means are also provided for moving the support plate between a first position wherein the heads are spaced from the respective partition intersections and a second position wherein the heads engage the respective partition intersections to position the partitions. Because the straightening heads operate on the intersections of the partitions rather than in the center of the compartments, the apparatus is capable of straightening more deformed partitions, fewer straightening heads are required, and the same straightening head may be used to straighten compartments of different sizes.

22 Claims, 10 Drawing Figures

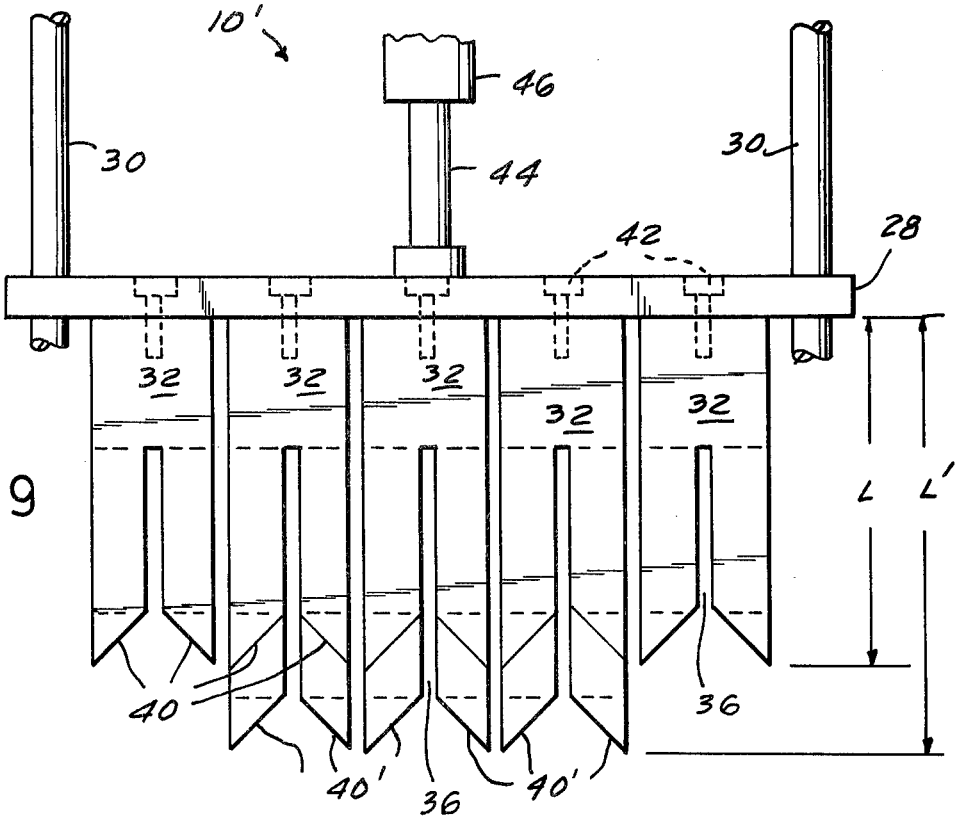
FIG. 9
FIG. 10
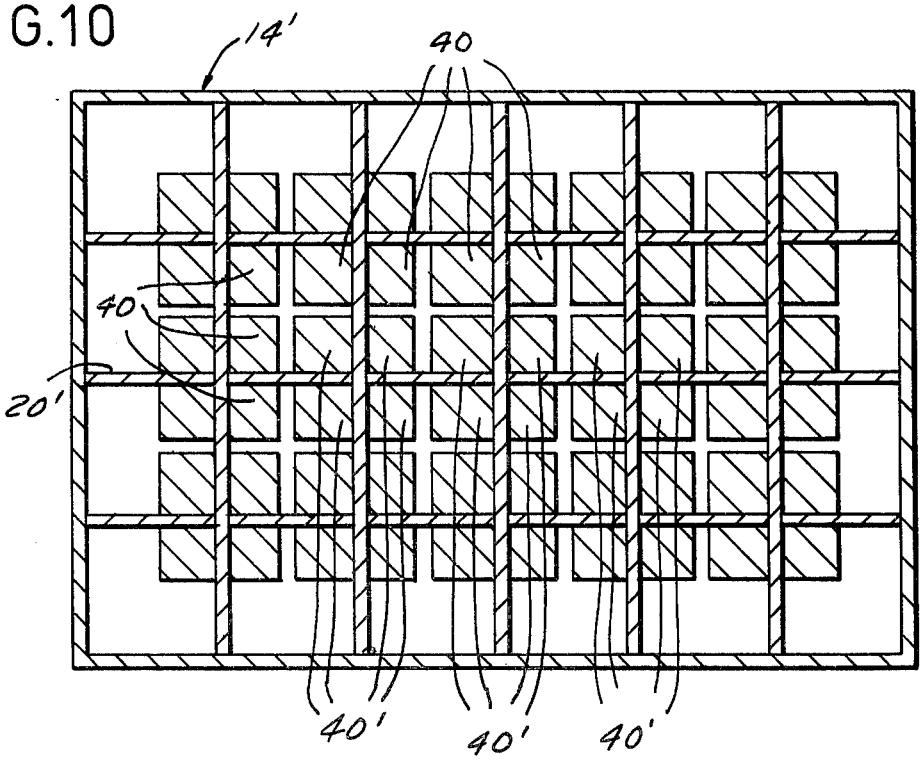

PARTITION POSITIONER

BACKGROUND OF THE INVENTION

The present invention relates to apparatus for positioning partitions in a container, and more particularly to apparatus adapted to align and straighten intersecting partitions in the container to form compartments to receive articles.

Where a plurality of articles (for example, glass bottles) are to be arranged in a container in a plurality of parallel rows, it is frequently desired to place a protective medium between the individual containers so they will better withstand shipment in the container. Containers to be thus packed are first provided with partitioning devices which divide the interior of the container into a plurality of open-top cells or compartments, each adapted to receive a single article, thereby to protect the article from contact with other articles. The partitioning device commonly employed for the purpose of forming the compartments comprises two intersecting sets of parallel strips of corrugated board or other material, the strips of each set being arranged in parallel spaced relation and held in such relation by means of interengaging notches or slits extending approximately half the width of the strips. As the placement of the partitions in the container must be done rather quickly in an automated packing process and as the corrugated board strips are both flexible and, to a certain degree, resilient, it frequently happens that the partitions forming the article compartments are not in proper place to receive the articles. Even when the partitions are initially placed into the container correctly, during the conveyance of the container from the partition-inserting station to the packing station, the partitions often become misaligned and require straightening prior to packing. Otherwise, as the articles are being inserted through the misaligned partition into the partially closed compartments, they are apt to jam against the edges of the partitions and be prevented from entering their respective compartments. A partition positioning device is frequently used for automatically positioning the yielding partitions (i.e., the walls of the compartments) so that the partitions are aligned and straightened. This insures that the compartments are fully open and there will be no jamming of the articles as the charge of articles is placed in the container.

In unstraightened partition containers, even though the partitions are disarranged in random fashion, there sill exist target areas, that is, areas contained within the unstraightened partitions that are contained by the partitions when straightened. These target areas have been found to be consistently larger for the centermost partitions, thereby making them the easiest to properly position. Once the central compartments are properly positioned, the remaining target areas (for the outer compartments) increase in size, thereby facilitating the proper positioning of the outermost partitions.

The use of partition positioning devices in which the mandrels or plugs are aimed at the target areas (which are normally disposed at or closely adjacent to the center of the straightened compartments) and configured and dimensioned to substantially fully occupy the compartments so as to straighten the partitions defining the same has not proven to be entirely satisfactory. Except in those rare instances where the container has an odd number of compartments on each side (for example, a 3 × 3 container), there is no single centermost compartment into which a plug can enter and accordingly a plurality of plugs must be used to enter the plurality of centermost compartments. Accordingly, the initial straightening of the partitions does not occur at the centermost point of the container where straightening would be easiest due to the larger target area. Furthermore, the number of plugs required for the partition positioning device must be equal to the number of compartments to be formed, thereby contributing to the cost of manufacturing the partition positioning device. Finally, as each plug must substantially fill the compartment (or at least a horizontal cross-section thereof) to insure straightening of the partition walls thereof, the plugs must be changed in order to accommodate containers having compartments of different size, thereby increasing the cost of operating the partition positioning device.

Accordingly, it is an object of the present invention to provide a partition positioning device which initially acts directly on the center of the container where the location of the partitions is best known.

Another object is to provide such a device in which the number of plugs required to straighten the compartment walls formed by the partitions is substantially less than the number of compartments to be formed.

A further object is to provide such a device in which the same plug may be used to straighten the partition walls of compartments of various sizes.

SUMMARY OF THE INVENTION

It has now been found that the above and related objects of the present invention are obtained in a partition positioning device in which the plugs operate on the intersection of the partitions rather than in the center of the compartments. As a result, the device is capable of straightening a more deformed partition than was heretofore possible. Furthermore, fewer plugs are required and the same plug may be used to straighten compartments covering a range of sizes.

More particularly the apparatus for positioning intersecting partitions in a container to form compartments to receive articles comprises support means, a plurality of straightening heads or plugs extending from the support means in a given direction and means for moving the support means. Each of the heads is adapted to engage a respective intersection of two partitions in the container and defines an intersecting pair of open-bottomed slots for receipt therein of the respected partition intersection. The moving means is adapted to move the support means between a first position wherein the heads are spaced from the respective partition intersections and a second position wherein the heads engage the respective partition intersections to position the partitions.

Preferably the intersecting pair of slots in each head divide the head into four corners or legs. At least one of the legs typically extends further in the given direction than another of the legs, and preferably one adjacent pair of the legs extends further in a given direction than the other adjacent pair of legs.

In a preferred embodiment each of the legs comprises a body of generally rectangular cross-section secured to the support means and a bevelled tip extending from the body in the given direction, the tip sloping upwardly and outwardly toward each of the two adjacent legs or corners of the same head. The tip preferably slopes upwardly and outwardly toward each of the two adjacent legs or corners of the same head at an angle of 35–45 degrees.

The plurality of heads is equal to the plurality of partition intersections in the container and preferably comprises a first group of heads and a second group of heads, the heads of the first group normally extending further in a given direction than the heads of the second group. Preferably the first group of heads extends along a central longitudinal axis of the container and is substantially surrounded by the second group of heads.

Preferably each of the head slots has a width intermediate the width of a partition and the width of a partition plus 0.06 inch.

BRIEF DESCRIPTION OF THE DRAWING

FIG. 9 is a fragmentary side elevation view of a second embodiment of the present invention adapted for use with a 4 × 6 container having a central longitudinal partition; and FIG. 10 is a top plan view, partially in cross-section, of a container after insertion of the partition positioner of FIG. 9.

DETAILED DESCRIPTION OF THE PREFERRED EMBODIMENTS

Figure 1:
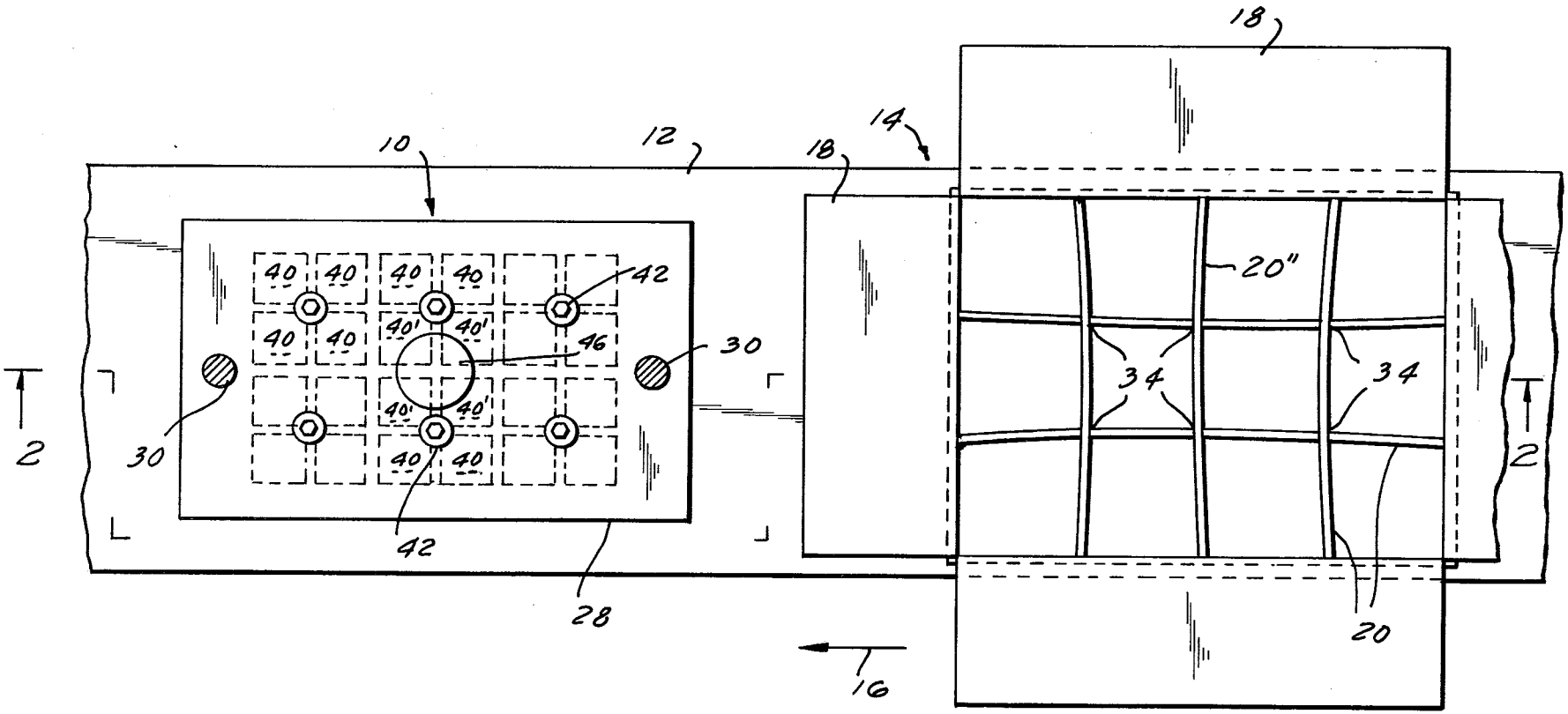
FIG. 1 is a fragmentary top plan view of a first embodiment of a partition positioner according to the present invention disposed over a conveyor carrying a 3 × 4 container (lacking a central longitudinal partion) with unstraightened partitions.
Figure 2:
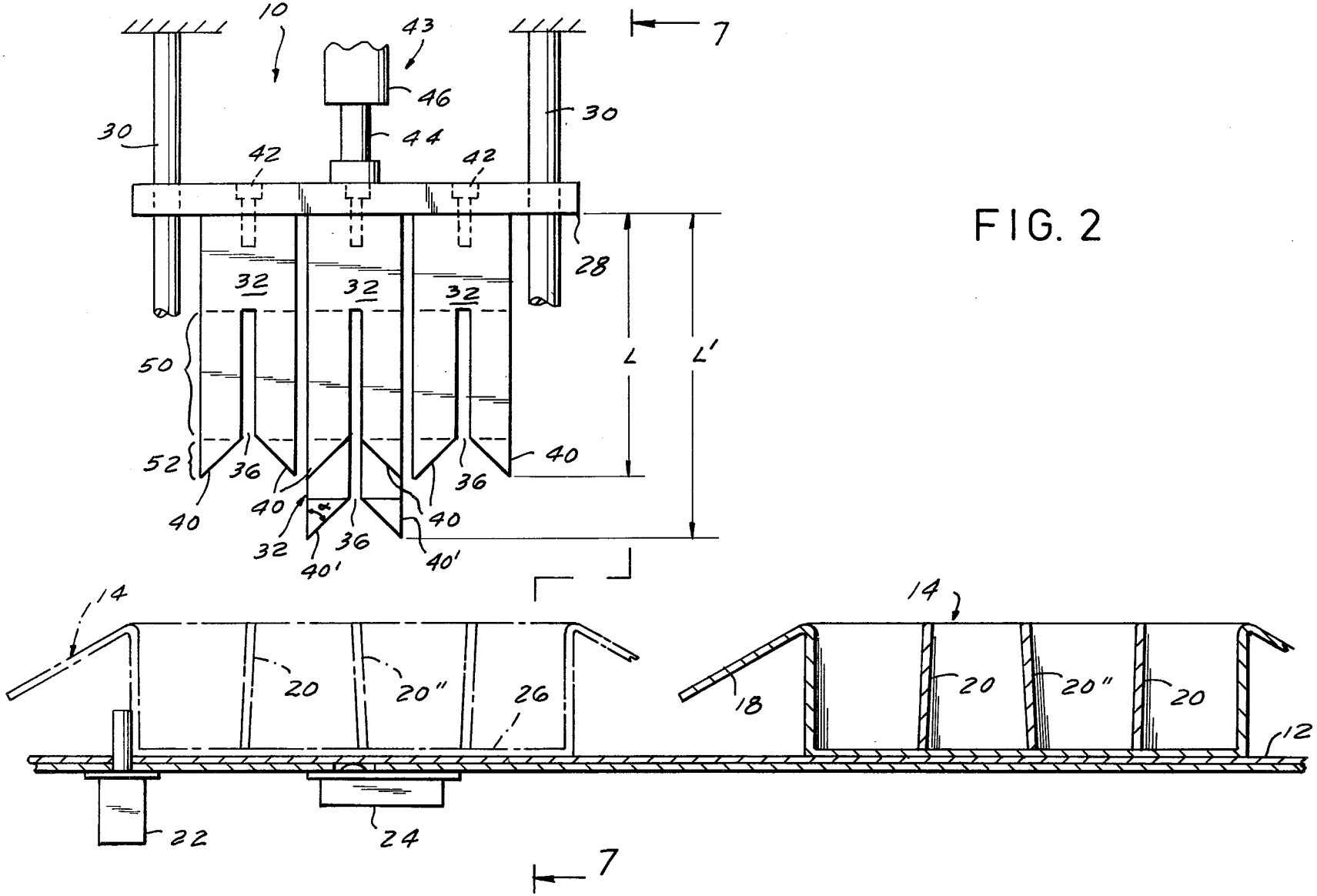
FIG. 2 is a fragmentary side elevation view, partially in cross-section, taken along the line 2—2 of FIG. 1, with a carton having unstraightened partitions being illustrated in phantom line directly underneath the partition positioner.

Referring now to the drawing, and in particular to FIGS. 1–2 thereof, therein illustrated is a partition positioner generally designated 10 and disposed above a conventional conveyor 12 adapted to transport a container generally designated 14 in the direction of arrow 16. The container 14 may be a conventional box or carbon having its top flaps 18 opened to reveal an unstraightened grid work of intersecting partitions 20. Typically, both the carton 14 and the partitions 20 are formed of corrugated board, although plastics and other materials suitable for the purpose may be employed, providing the partition material is flexible and, to a degree, resilient.

Referring now particular to FIG. 2, a conventional retractable case stop 22 associated with conveyor 12 is employed to immobilize the container 14 in proper position for operation of the partition positioner, as illustrated in phantom line. A conventional pressure-sensitive limit switch 24 is disposed under a portion of the conveyor 12 supporting the carton 14 being acted upon by the partition positioner 10. Should a partition positioner plug in its downward descent encounter an obstacle other than the carton bottom 26 of a partition 20 (for example, an open flap 18), the limit switch 24 will be tripped, thus causing the partition positioner plugs to return to their original position spaced above the container 14 so that the unopened flap 18 may be manually opened by an attendant.

The support means of the partition positioner 10 comprises a plate 28 spaced above and parallel to the conveyor 12, the support structure for the partition positioner 10 preferably including a pair of vertically extending guide rods 30 which slidingly pass through apertures in the support means 28 to maintain the support means 28 horizontal, and hence parallel to the conveyor 12. A plurality of straightening heads or plugs generally designated 32 extend downwardly from the support means 28 in the direction of the container bottom 26. The plugs 32 may be formed of any suitable material, hardwood being especially preferred for ease of working and economic reasons. Each of the plugs 32 is adapted to engage a respective intersection 34 of two partitions 20 in the container 14 and defines an intersecting pair of open-bottom slots 36 for receipt therein of the respective partition intersection 34. The intersecting pair of slots 36 in each plug 32 divide the bottom of the plug into four legs 40.

The tops of the plugs 32 are secured to the support means 28 by means of bolts 42, although other conventional fastening systems may be employed if desired. The support means 28 is in turn secured by conventional means to moving means, generally designated 43, for raising and lowering the support means 28; for example, the piston 44 of a hydraulically or pneumatically operated cylinder 46. Obviously other conventional moving means 43 may be employed in place of piston 44 and cylinder 46. The moving means 43 is adapted to move the support means 28 between a first position wherein the plugs 32 are spaced above the respected partition intersections 34 (so as to enable movement of the container 14 into and out of the position in which it is operated on by the plugs 32), and a second position wherein the plugs 32 engage the respective partition intersections 34 to position the partitions 20. The moving means 43 is preferably also connected, either directly or though a control unit (not shown), to the limits switch 24 so that the downward descent of the support means 28 (and hence the plugs 32) may be terminated and reversed in the event that the plugs 32, in moving from the first position to the second position, encounter an unexpected obstacle such as a mispositioned flap 18 and thus trip the limit switch 24. The slots 36 extend upwardly (toward the support means 28) a distance sufficient to accommodate the height of the partitions 20 when the plugs 32 are in the second position. If a conventional flap holddown bar (not shown) is being employed to maintain the flaps 18 in their open position, at least the slots 36 vertically aligned with the holddown bar must extend upwardly a further distance sufficient to accommodate the height of the bar.

The principle of the present invention—namely, the use of plugs which operate on the intersection of the partitions as opposed to the centers of the compartments formed by the partitions—is equally applicable to containers which have a center or central longitudinal partition and those that do not, although different embodiments are preferably used in each case. FIGS. 1–8 relate to an embodiment 10 of the present invention suitable for use with a container 14 lacking a center longitudinal partition 20, while FIGS. 9–10 relate to an embodiment 10' useful for containers 14' having a center longitudinal partition 20'. It will be appreciated that a center or central longitudinal partition is one which extends along the long axis of the rectangular container 14' (as opposed to the short axis thereof) and is equidistantly spaced from the long sides of the container 14'. It will be further appreciated that the 3 × 4 container 14 (having 12 compartments) illustrated in FIGS. 1–8 is only representative of those lacking a center longitudinal partition, and that the 4 × 6 container 14' (having 24 compartments) illustrated in FIG. 10 is only representative of those containers having a center longitudinal partition.

Referring now to FIGS. 1–8, therein illustrated is an arrangement of plugs adapted to straighten the partitions in a 3 × 4 container lacking a center longitudinal partition. This embodiment employs a total of six plugs 32, four plugs of a first type, and two plugs of a second type. The total number of plugs 32 required for a given container 14 will be equal to the number of partition intersections 34 in the container 14. (By way of contrast, in the prior art devices wherein the plugs worked on the compartments rather than the partition intersections, the total number of plugs required was equal to the number of compartments in the container. Thus in the prior art device twelve plugs would be required for the twelve compartment container illustrated, as opposed to the six plugs required by the present apparatus which works on the partition intersections).

In the first type of plug 32, the legs 40 formed by the slots 36 extend downwardly from the support means 28 by the same given distance L. Each leg 40 comprises a body 50 of generally rectangular cross-section secured to the support means 28 by bolt 42 and a bevelled tip 52 extending downwardly from the body 50. The tip 52 has two adjacent vertical sides facing outwardly from the plug 32 and two adjacent bevelled sides, each of the bevelled sides sloping upwardly and outwardly toward a respective one of the adjacent legs 40 of the same plug 32, preferably at an angle $\alpha$ of 35–45 degrees to the vertical. If the angle $\alpha$ is greater than 45°, the tip 52 is overly flat and tends to crush the partition downwardly rather than merely displacing it to one side or another as required to properly position it. If the angle $\alpha$ is smaller than 35° and the plug 32 is not going to be inserted all the way to the container bottom 26, the tip 52 may fail to properly position the partition because the partition is never displaced into the slot 36. Generally, an angle $\alpha$ of 35°–40° is preferred, especially 40°, although a lesser angle may be used where the plug will be inserted into the container to a depth sufficient to insure entry of the partition 20 into the slots 36. The width of a slot 36 is preferably intermediate the width of the partition 20 to be grasped by the slot and the width of the partition plus 0.06 inch. A corrugated board partition generally has a thickness of about 0.37 inch while a chip board partition generally has a thickness of about 0.25 inch. However, a partition tends to vary somewhat in thickness over its length, and it is therefore preferred that the slot be slightly wider then the theoretical or average partition width in order to avoid possible binding. On the other hand, the width of the slot must be sufficiently narrow to enable the slot to snugly grasp the partition to straighten the same.

Whereas in the first type of plug all of the legs 40 (that is, the lowermost portions of the plug tips 52) extend downwardly from the support means 28 towards the container bottom 26 the same distance L, in the second type of plug one adjacent pair of legs 40 extends a distance L and the other adjacent pair of legs 40' extends a distance L', where L' is greater than L so that legs 40' extend further towards the container bottom 26 than legs 40. The two plugs of the second type are disposed so that for each plug the two long legs 40' are disposed on opposite sides of the center segment of the central transverse or cross partition 20'' of the container 14. As the moving means 43 lowers the support means 28, the long legs 40' contact partitions 20, 20'' in the center of the container 14 and commence the straightening and aligning process as the bevel tips 52 force the partitions 20, 20'' into the slots 36. More particularly, one-half of each of two plugs 32 set side-by-side along the transverse axis square the cross partition 22'' and center it in the container 14, thus commencing the aligning and straightening process and moving the other partitions more closely into their final position. (They also may commence centering of the longitudinal partition 20, depending on the original position of the latter.)

Figure 3:
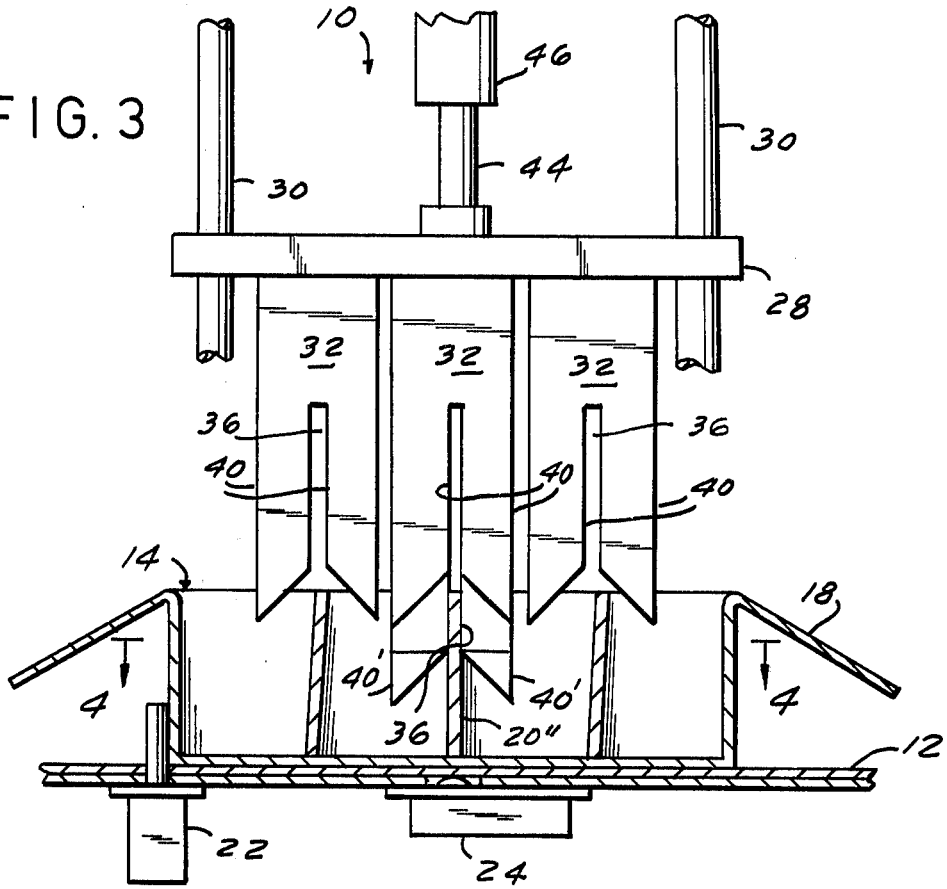
FIG. 3 is a fragmentary side elevation view similar to FIG. 2, but showing the plugs in an intermediate stage of insertion.
Figure 4:
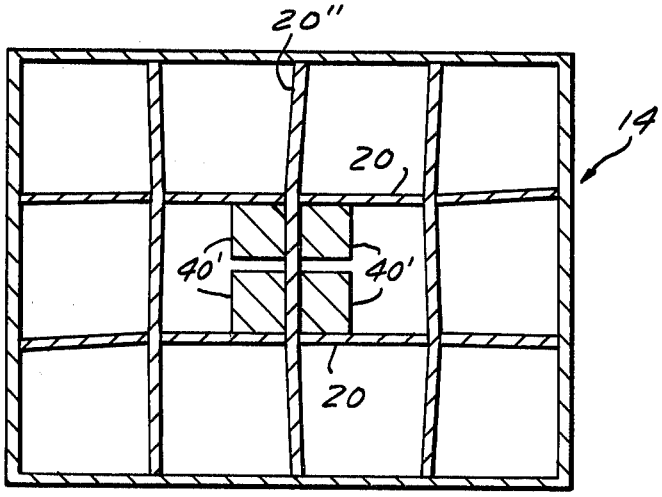
FIG. 4 is a top plan view, partially in cross-section, taken along the line 4—4 of FIG. 3.
Figure 5:
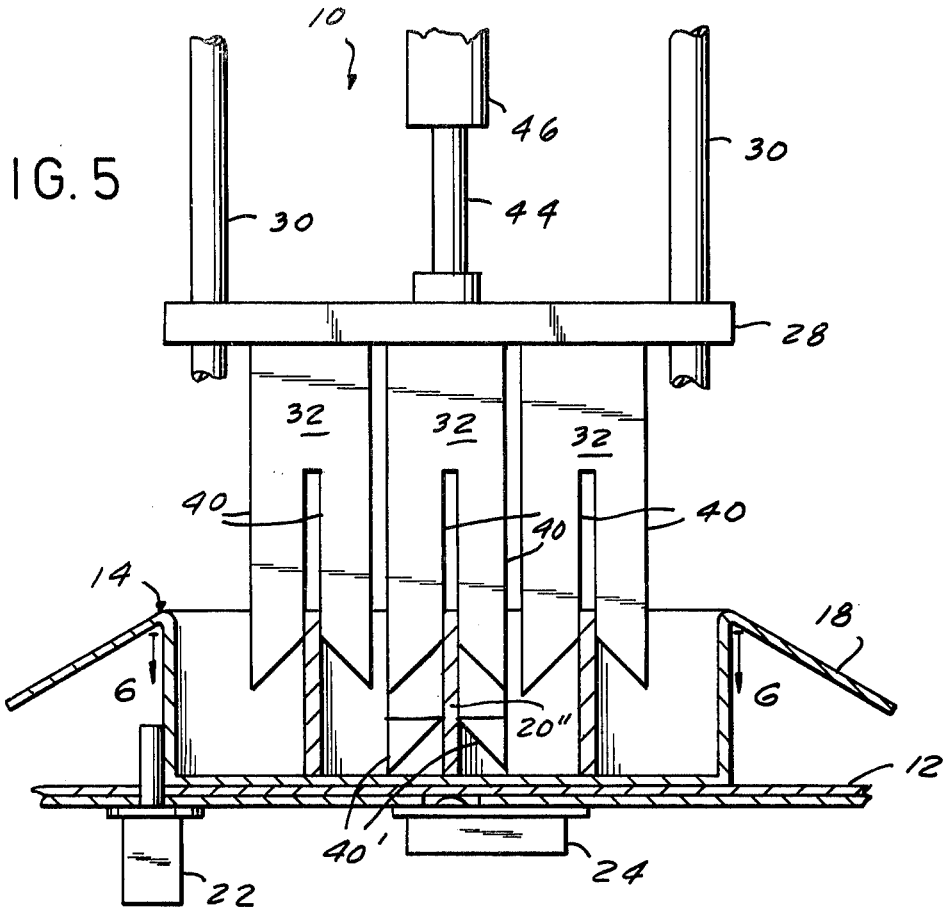
FIG. 5 is a fragmentary side elevation view similar to FIG. 3, but showing the plugs in the fully inserted stage.
Figure 6:
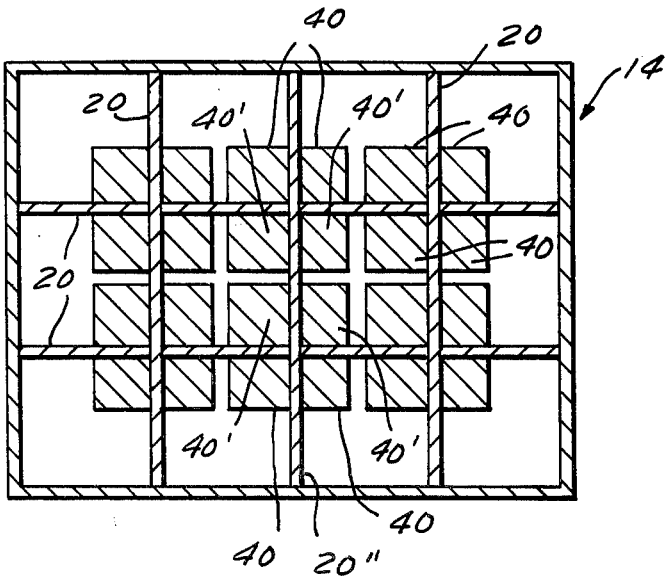
FIG. 6 is a top plan view, partially in cross-section, taken along the line 6—6 of FIG. 5.
Figure 7:
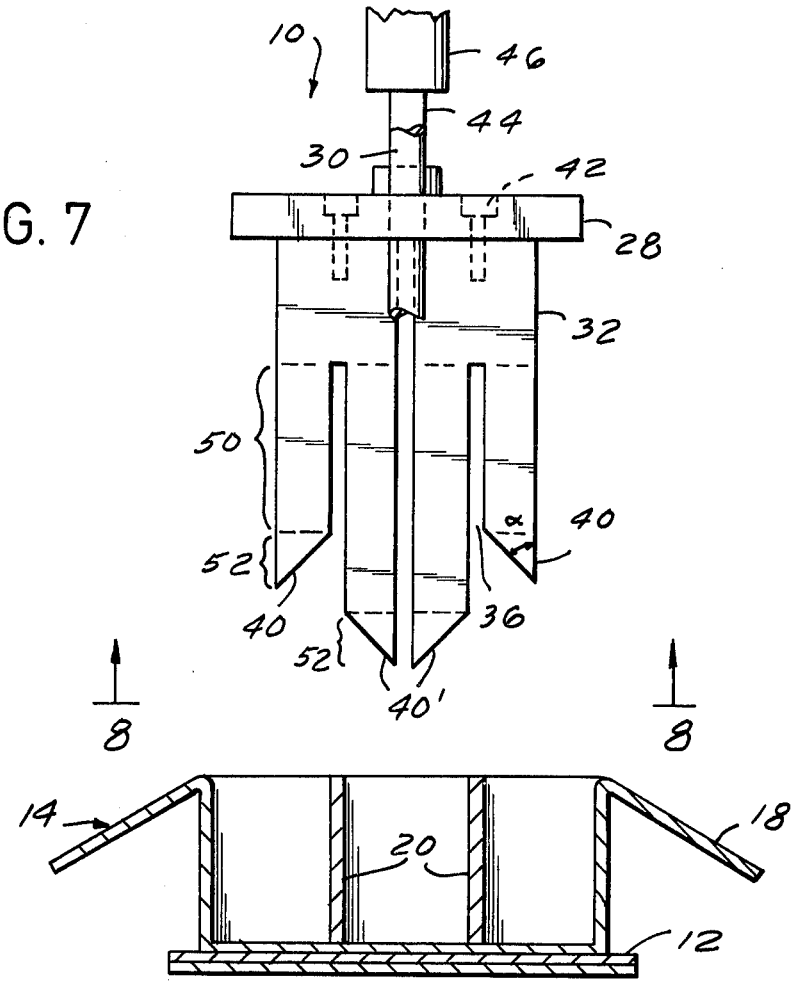
FIG. 7 is a fragmentary end elevation view, partially in cross-section, taken along the line 7—7 of FIG. 2.
Figure 8:
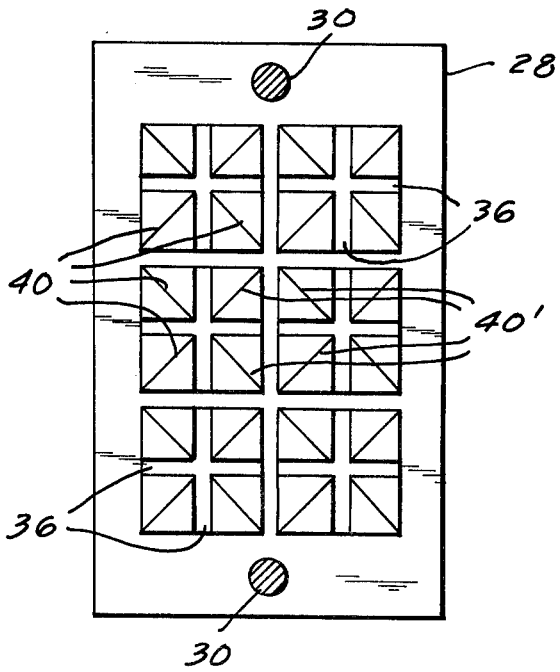
FIG. 8 is a bottom plan view taken along the line 8—8 of FIG. 7.

Operation of the first embodiment of the partition positioner is very simple. Referring now to FIGS. 1–2 and 7–8, the container 14 with open flaps 18 is transported by conveyor 12 into position underneath the partition positioner 10 (in the direction of arrow 16) where it is held against further motion by the action of extended container stop 22. Referring now to FIGS. 3–4, cylinder 46 is actuated to lower support means 28 and, as the support means 28 lowers, long legs 40' engage the center cross partition 20'', the bevel tips 52 thereof directing the center cross partition 20'' into the transverse slots 36. Referring now to FIGS. 5–6, further descent of the support means 28 causes short legs 40 to engage and properly position the remaining partitions 20 and the outer segments of cross partition 20''. More particularly, the short legs 40 of the second type of plug (i.e., those also containing long legs 40') complete straightening of the center cross partition 20'' and cooperate with the long legs 40' to straighten the center segments of the two longitudinal partitions 20; the short legs 40 of the first type of plug (i.e., those containing only short legs 40) straighten the two outer cross partitions 20 and the outer segments of the two longitudinal partitions 20.

The descent of the support means 28 is terminated and reversed when the long legs 40' approach or contact the container bottom 26, at which point the piston 46 is caused to withdraw support means 28 until both the short legs 40 and long legs 40' are withdrawn from the container 14. Extended container stop 22 is retracted, and the container 14 is carried away by the conveyor 12.

It has been found that the positioning process is facilitated by imparting a slight vibratory action to the container during the process, for example, by use of a conventional vibratory plate disposed under the conveyor or other means well recognized in the art for imparting a vibratory motion to a container on a conveyor.

In conventional partition positioners the plug must closely conform to the size of the compartment in order to properly "block" the partitions to form a compartment. However as the straightening of the partitions according to the present invention is accomplished essentially by means of slots 36 acting on partition intersections, it will be appreciated that the same plug 32 may be used for a variety of different compartment sizes. For example, a 2.5 × 2.5 inch plug may be used for compartments of from 2.5 × 2.5 to 3.5 × 3.5 inches. On the one hand, the compartment must be large enough to accommodate the four legs 40 or 40, 40' to be inserted therein (one from each of four different plugs 32) and, on the other hand, the length of a compartment wall must not be so great that the ends thereof could be straightened by the legs while leaving the center thereof askew.

While the various plugs 32 have been shown as individually attached to the support means 28, by bolts 42, clearly a given configuration of plugs 32 can be mounted on an intermediate plate (not shown) for attachment to and removal from the support means 28 as a unit, thus facilitating modification of the partition positioner to accomodate different container patterns and sizes.

Referring now particularly to FIGS. 2 and 5, it will be apparent that where the difference in the length of the legs 40 and 40' (corresponding to the difference between L and L') exceeds the height of the partitions 20, the descent of the support means 28 would be terminated by the abutment of the long legs 40' against the carton bottom 26 prior to the time that the short legs 40 have an opportunity to perform their function. On the other hand, if the difference in length is too little, the long legs 40' will not have had an opportunity to complete straightening of the center partitions in time to position the remaining partitions for subsequent action thereon by the short legs 40. It has been found that the system illustrated operates effectively where the partition is approximately 4 inches or more in height, thus enabling a difference in length between the short and long legs of at least two inches (assuming the tips 52 are one inch in length). For shorter cases the long leg 40' of the second type of plug 32 or the entire third type of plug 32 (to be described hereinbelow) may be spring loaded. Alternatively, in the case of the second embodiment, the center plugs may be spring loaded, or the center plugs may be mounted on a separate support means than the other plugs and connected to a separate moving means so that, even after the downward motion of the center plugs under the center plug moving means has been terminated, the outer plugs may be further lowered under the power of the outer plug moving means, or, a system such as that described in U.S. Pat. application Ser. No. 856,612 entitled "PARTITION POSITIONER" (filed on even date herewith by William C. Butt) may be employed.

Referring now to FIGS. 9 and 10, therein illustrated is the second embodiment 10' of the present invention adapted for use with container 14' having a center longitudinal partition 20', such as a 4 × 6 container. The second embodiment 10' is substantially similar to the first embodiment 10 except that depending from the support means 28 are fifteen plugs 32, twelve plugs of the first type (having only short legs 40) and three plugs of the earlier referenced third type. The third type of plug is identical to the first type of plug except that all four legs 40' are slightly longer, preferably by about two inches. The three plugs of the third type are disposed along the central longitudinal partition 20' intermediate the outer cross partitions 20 of the carton 14'. Operation of the second embodiment is similar to that of the first embodiment except that during the initial stage of descent of the support means 28 there are twelve long legs 40' entering the container 14' (as opposed to only four), and at the last stage forty-eight short legs 40 entering the container 14' (as opposed to sixteen). The twelve long legs 40' act to properly position the central longitudinal partition for substantially its entire length intermediate the outer cross partitions 20 as well as to partially straighten the three inner cross partitions 20.

It will be appreciated that the number of plugs 32 required in the second embodiment is, as in the first embodiment, equal to the number of partition intersections in the container. The plurality of plugs are divided into first and second groups of plugs, the plugs of the first group being of the third type and normally extending further downwardly than the plugs of the second group (that is, the first type of plugs). The second group of heads substantially surrounds the first group of heads, which in turn extend along a central longitudinal partition of the container.

To summarize, the present invention provides a partition positioner which initially acts directly on the center of the container where the location of the partitions is best known, utilizes only as many plugs as there are partition intersections in the container, and permits the same plug to be used for forming compartments of various sizes.

Now that the preferred embodiments of the present invention have been shown and described in detail, various modification and improvements thereon will become readily apparent to those skilled in the art. Accordingly, the spirit and scope of the present invention is to be limited only by the appended claims and not by the foregoing disclosure.

I claim:

1. Apparatus for positioning intersecting partitions in a container to form compartments to receive articles comprising:

A. support means;

B. a plurality of straightening heads extending from said support means in a given direction, each of said heads being adapted to engage a respective intersection of two partitions in the container and defining an intersecting pair of open-bottomed slots for receipt therein of the respective partition intersection, said intersecting pair of slots in each head dividing said head into a plurality of legs, said legs being configured and dimensioned to enable insertion of a plurality of said legs into a given compartment; and C. means for moving said support means between a first position wherein said heads are spaced from the respective partition intersections and a second position wherein said heads engage the respective partition intersections to position the partitions.

2. The apparatus of claim 1 wherein said intersecting pair of slots in each head divide said head into four legs.

3. The apparatus of claim 1 wherein said support means is removably secured to said moving means.

4. The apparatus of claim 1 wherein each of said slots has a width intermediate the width of a partition and the width of a partition plus 0.06 inch.

5. Apparatus for positioning intersecting partitions in a container to form compartments to receive articles comprising:

A. support means;

B. a plurality of straightening heads extending from said support means in a given direction, each of said heads being adapted to engage a respective intersection of two partitions in the container and defining an intersecting pair of open-bottomed slots for receipt therein of the respective partition intersection, said intersecting pair of slots in each head dividing said head into a plurality of legs, each of said legs comprising a body of generally rectangular cross-section secured to said support means and a beveled tip extending from said body in said given direction, said tip sloping upwardly and outwardly toward each of the two adjacent legs of the same head; and C. means for moving said support means between a first position wherein said heads are spaced from the respective partition intersections and a second position wherein said heads engage the respective partition intersections to position the partitions.

6. The apparatus of claim 5 wherein said tip slopes upwardly toward each of the two adjacent legs of the same head at an angle of 35–45 degrees.

7. Apparatus for positioning intersecting partitions in a container to form compartments to receive articles comprising:

A. support means;

B. a plurality of straightening heads extending from said support means in a given direction, said plurality of heads being equal to the number of partition intersections in the container each of said heads being adapted to engage a respective intersection of two partitions in the container and defining an intersecting pair of open-bottomed slots for receipt therein of the respective partition intersection; and C. means for moving said support means between a first position wherein said heads are spaced from the respective partition intersections and a second position wherein said heads engage the respective partition intersections to position the partitions.

8. Apparatus for positioning intersecting partitions in a container to form compartments to receive articles comprising:

A. support means;

B. a plurality of straightening heads extending from said support means in a given direction, said plurality of heads comprising a first group of heads and a second group of heads, said heads of said first group normally extending further in said given direction than said heads of said second group, each of said heads being adapted to engage a respective intersection of two partitions in the container and defining an intersecting pair of open-bottomed slots for receipt therein of the respective partition intersection; and C. means for moving said support means between a first position wherein said heads are spaced from the respective partition intersections and a second position wherein said heads engage the respective partition intersections to position the partitions.

9. The apparatus of claim 8 wherein said first group of heads extends along a central longitudinal axis of the container.

10. The apparatus of claim 8 wherein said second group of heads substantially surrounds said first group of heads.

11. The apparatus of claim 8 wherein said intersecting pair of slots in each head divide said head into four legs.

12. The apparatus of claim 11 wherein each of said slots has a width intermediate the width of a partition and the width of a partition plus 0.06 inch.

13. The apparatus of claim 12 wherein at least one of said legs extends further in said given direction than another of said legs.

14. The apparatus of claim 12 wherein one adjacent pair of said legs extends further in said given direction than the other adjacent pair of said legs.

15. The apparatus of claim 11 wherein at least one of said legs extends further in said given direction than another of said legs.

16. The apparatus of claim 11 wherein one adjacent pair of said legs extends further in said given direction than the other adjacent pair of said legs.

17. The apparatus of claim 11 wherein each of said legs comprises a body of generally rectangular cross-section secured to said support means and a beveled tip extending from said body in said given direction, said tip sloping upwardly and outwardly toward each of the two adjacent legs of the same head.

18. The apparatus of claim 12 wherein each of said legs comprises a body of generally rectangular cross-section secured to said support means and a beveled tip extending from said body in said given direction, said tip sloping upwardly and outwardly toward each of the two adjacent legs of the same head.

19. Apparatus for postitioning intersecting partitions in a container to form compartments to receive articles comprising:

A. support means;

B. a plurality of straightening heads extending from said support means in a given direction, each of said heads being adapted to engage a respective intersection of two partitions in the container and defining an intersecting pair of open-bottomed slots for receipt therein of the respective partition intersection, said intersecting pair of slots in each head dividing said head into a plurality of legs, at least one of said legs extending further in said given direction than another of said legs; and C. means for moving said support means between a first position wherein said heads are spaced from the respective partition intersections and a second position wherein said heads engage the respective partition intersections to position the partitions.

20. The apparatus of claim 19 wherein one adjacent pair of said legs extends further in said given direction than the other adjacent pair of said legs.

21. Apparatus for positioning intersecting partitions in a container to form compartments to receive articles comprising:

A. support means;

B. a plurality of straightening heads extending from said support means in a given direction, each of said heads being adapted to engage a respective intersection of two partitions in the container and defining an intersecting pair of open-bottomed slots for receipt therein of the respective partition intersection;

C. means for moving said support means between a first position wherein said heads are spaced form the respective partition intersections and a second position wherein said heads engage the respective partition intersections to position the partitions; and D. means to vibrate the container during movement of said support means from said first position into said second position.

22. The apparatus of claim 21 wherein each of said slots has a width intermediate the width of a partition and the width of a partition plus 0.06 inch.

* * * * *